US005352171A

United States Patent [19]

Lin

[11] Patent Number: 5,352,171

[45] Date of Patent: Oct. 4, 1994

[54] EXERCISE MACHINE MAKING USE OF BODY WEIGHT OF EXERCISER AS LOAD WEIGHT THEREOF

[75] Inventor: Chin-Ta Lin, Taichung Hsien, Taiwan

[73] Assignee: Kuo-Chung Shieh, Taichung Hsien, Taiwan

[21] Appl. No.: 188,758

[22] Filed: Jan. 31, 1994

[51] Int. Cl.[5] ..... A63B 21/068

[52] U.S. Cl. ..... 482/96; 482/137; 482/142

[58] Field of Search ..... 482/95, 96, 110, 133, 482/135, 136, 137, 142

[56] References Cited

U.S. PATENT DOCUMENTS

| | | | |
|---|---|---|---|
| 248,121 | 10/1881 | Tuttle | 482/96 |
| 2,924,456 | 2/1960 | Miller | 482/96 |
| 4,964,632 | 10/1990 | Rockwell | 482/137 |
| 5,156,650 | 10/1992 | Bals | 482/95 |
| 5,178,599 | 1/1993 | Scott | 482/96 |
| 5,201,694 | 4/1993 | Zappel | 482/96 |

*Primary Examiner*—Richard J. Apley
*Assistant Examiner*—Lynne A. Reichard
*Attorney, Agent, or Firm*—Browdy and Neimark

[57] ABSTRACT

An exercise machine making use of the body weight of an exerciser as a load weight thereof comprises a base, a fixation rod member, an upper rocking bar member, a lower rocking bar member, an expandable connection bar member, a seat pad, a back pad, a handle, and a cushioning member. Unlike a conventional exercise machine, the exercise machine so disclosed is composed of no weights. The fixation rod member can be adjusted in accordance with the height of an exerciser. The length of the expandable connection rod member can be adjusted by adjusting the pivoting position of the upper rocking bar member or the length of the fixation rod member. The exerciser can use the machine by seating or standing on the seat pad of the machine for doing the muscle-building exercise.

4 Claims, 5 Drawing Sheets

EXERCISE MACHINE MAKING USE OF BODY WEIGHT OF EXERCISER AS LOAD WEIGHT THEREOF

FIELD OF THE INVENTION

The present invention relates generally to an exercise machine, and more particularly to an exercise machine which makes use of the body weight of an exerciser as a load weight of the machine.

BACKGROUND OF THE INVENTION

The conventional exercise machine is generally provided with various weights, which are lifted by means of steel cables and pulleys for the purpose of building the body of a person using the exercise machine. Such a conventional exercise machine as described above is defective in that its weights are costly and that it is expensive and inconvenient to transport the weights.

SUMMARY OF THE INVENTION

It is therefore the primary objective of the present invention to provide an exercise machine making use of the body weight of an exerciser as a load weight in place of a weight.

The foregoing objective of the present invention is attained by an exercise machine, which comprises a base, a fixation rod, an upper rocking bar, a lower rocking bar, an expandable connection rod, a seat pad, a back pad, a handle, and a cushioning member.

The fixation rod is fastened obliquely to the base. The upper rocking bar is provided with a plurality of through holes and fastened pivotally to the top end of the fixation rod. The lower rocking bar is pivoted to the fixation rod such that the lower rocking bar is located under the upper rocking bar. The expandable connection rod is pivoted respectively at both ends thereof to the upper and the lower rocking bars and is located behind the fixation rod. The seat pad is disposed on one end of the lower rocking bar. The back pad is pivoted at one end thereof to the lower rocking bar and fastened at another end thereof to the fixation rod. The handle is fastened to one end of the upper rocking rod. The cushioning member is pivoted at one end thereof to the lower rocking bar and fastened at another end thereof to the fixation rod.

DETAILED DESCRIPTION OF THE INVENTION

Figure 1:
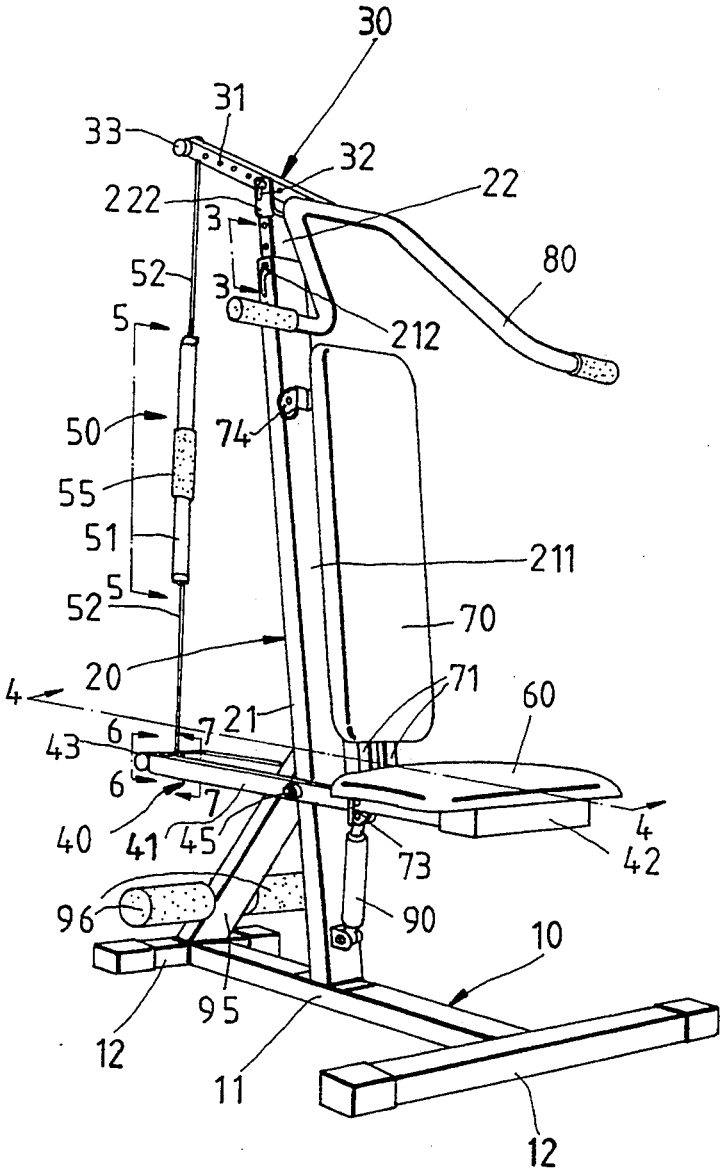
FIG. 1 shows a perspective view of the present invention.

As shown in FIG. 1, the exercise machine of the present invention is made up of the component parts described hereinafter.

A base 10 is composed of a main tube 11, two cross tubes 12 fastened vertically and respectively to both ends of the main tube 11. The base 10 is placed horizontally on a flat surface.

Figure 3:
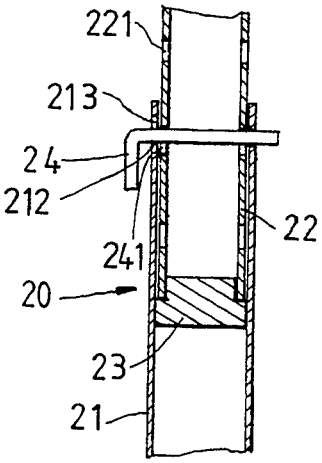
FIG. 3 shows a sectional view of a portion taken along the line 3—3 as shown in FIG. 1.
Figure 2:
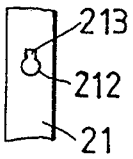
FIG. 2 shows the shape of a key hole of the present invention.

A fixation rod member 20 comprises an outer tube 21 fastened obliquely to the main tube 11 of the base 10. The fixation rod member 20 has a front surface 211 which forms a greater angle with the upper surface of the main tube 11. The fixation rod member 20 is provided in one side of the top end thereof with a key hole 212, as shown in FIG. 2. The fixation rod member 20 is further composed of an inner tube 22 received adjustably in the axial hole of the outer tube 21, as illustrated in FIG. 3. The inner tube 22 is provided at the bottom thereof with a sleeve 23 fitted thereover for making the inner tube 22 to become more closely associated with the outer tube 21. The inner tube 22 is provided with a plurality of through holes 221. The fixation rod member 20 is still further provided with an L-shaped insertion pin 24, which is put through the key hole 212 and one of the through holes 221 of the inner tube 22 for fastening and locating the inner tube 22 and the outer tube 21. The insertion pin 24 has a protruded portion 241 capable of working in conjunction with a slot 213 of the key hole 212 to prevent the insertion pin 24 from becoming disengaged.

An upper rocking bar member 30 is provided with a predetermined number of through holes 31 and is pivoted by means of an L pin 32 to two lugs 222 located at the top of the inner tube. As a result, the upper rocking bar member 30 is provided with an adjustable fulcrum. The upper rocking bar member 30 has a round tube 33 opposite to the back surface of the outer tube 21. The round tube 33 is provided centrally and radially with a long slot, which is not shown in the drawing.

Figure 4:
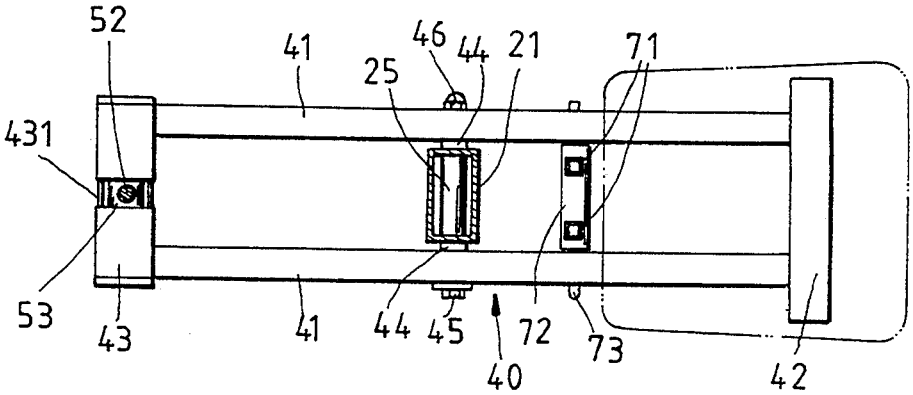
FIG. 4 shows a sectional view of a portion taken along the line 4—4 as shown in FIG. 1.

As shown in FIG. 4, a lower rocking rod member 40 comprises two parallel tubes 41, one support tube 42 fastened to the two parallel tubes 41, and a round tube 43 fastened to the two parallel tubes 41 and provided centrally and radially with a long slot 431. The outer tube 21 is provided at a predetermined position thereof with an inner sleeve 25. The lower rocking bar member 40 is arranged at both sides of the outer tube 21 by means of the two parallel tubes 41. Located between the outer tube 21 and the two parallel tubes 41 are two oily bearings 44. A threaded rod 45 is put through the inner sleeve 25, two bearings 44 and the two parallel tubes 41, and is then fastened with a nut 46.

Figure 5:
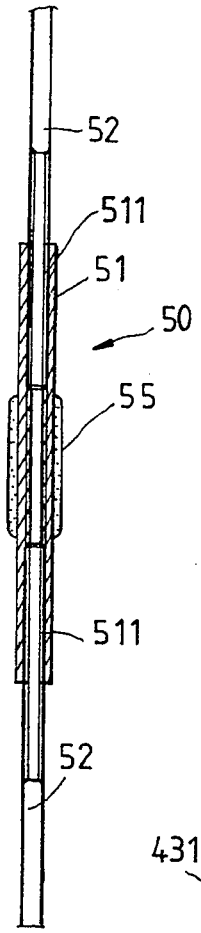
FIG. 5 shows a sectional view of a portion taken along the line 5—5 as shown in FIG. 1.
Figure 7:
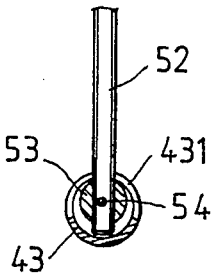
FIG. 7 shows a sectional view of a portion taken along the line 7—7 as shown in FIG. 1.
Figure 6:
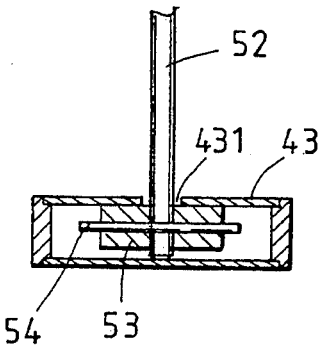
FIG. 6 shows a sectional view of a portion taken along the line 6—6 as shown in FIG. 1.

As shown in FIG. 5, an expandable connection rod 50 comprises a nut 51 of long tubular construction and having respectively at both ends thereof a reverse threaded hole 511, and two threaded rods 52 engaging respectively the threaded hole 511 and capable of being caused to move simultaneously in opposite directions. These two threaded rods 52 are disposed pivotally and respectively at one end thereof in the long slots of the round tubes 33 and 43 of the upper and the lower rocking bar members 30 and 40. In other words, the two threaded rods 52 are pivoted similarly to the upper and the lower rocking bar members 30 and 40. Therefore, only the pivoting method of the lower rocking bar member 40 is described here. As shown in FIGS. 6 and 7, the threaded rod 52 is put through the long slot 431 of the round tube 43 and a round rod 53 disposed in the round tube 43. An insertion pin 54 is put through the round rod 53 and the threaded rod 52 which is capable of rocking in the long slot 431. The nut 51 is additionally provided with an elastic tube 55 for providing an easy grip on the nut 51.

A seat pad is fastened securely to the support tube 42 of the lower rocking bar member 40.

A back pad 70, as shown in FIGS. 1 and 4, is provided with two support tubes 71 under which a round tube 72 is disposed securely. An L pin 73 is detachably pivoted between the two parallel tubes 41 of the lower rocking bar member 40. A rolling wheel 74 is pivotally mounted on the support tube 71 so that the back pad 70 is held on to the fixation rod member 20 when the lower rocking bar member 40 is caused to rock upwards and downwards.

A handle 80 is fastened to one end of the upper rocking bar member 30.

A cushioning member 90 of an oil-pressure cylinder is pivoted at one end thereof to the fixation rod member 20 (or the base 10) and at another end thereof to the lower rocking bar member 40, or the upper rocking bar member 30, or the connection bar member 50, for allowing the lower rocking bar member 40 to return to its stationary position at a moderate pace.

A bracing tube 95 is fastened at one end thereof to the base 10 and at another end thereof to the fixation rod member 20. Provided respectively at both sides of the bracing tube 95 is an elastic padded tube 96.

Figure 8:
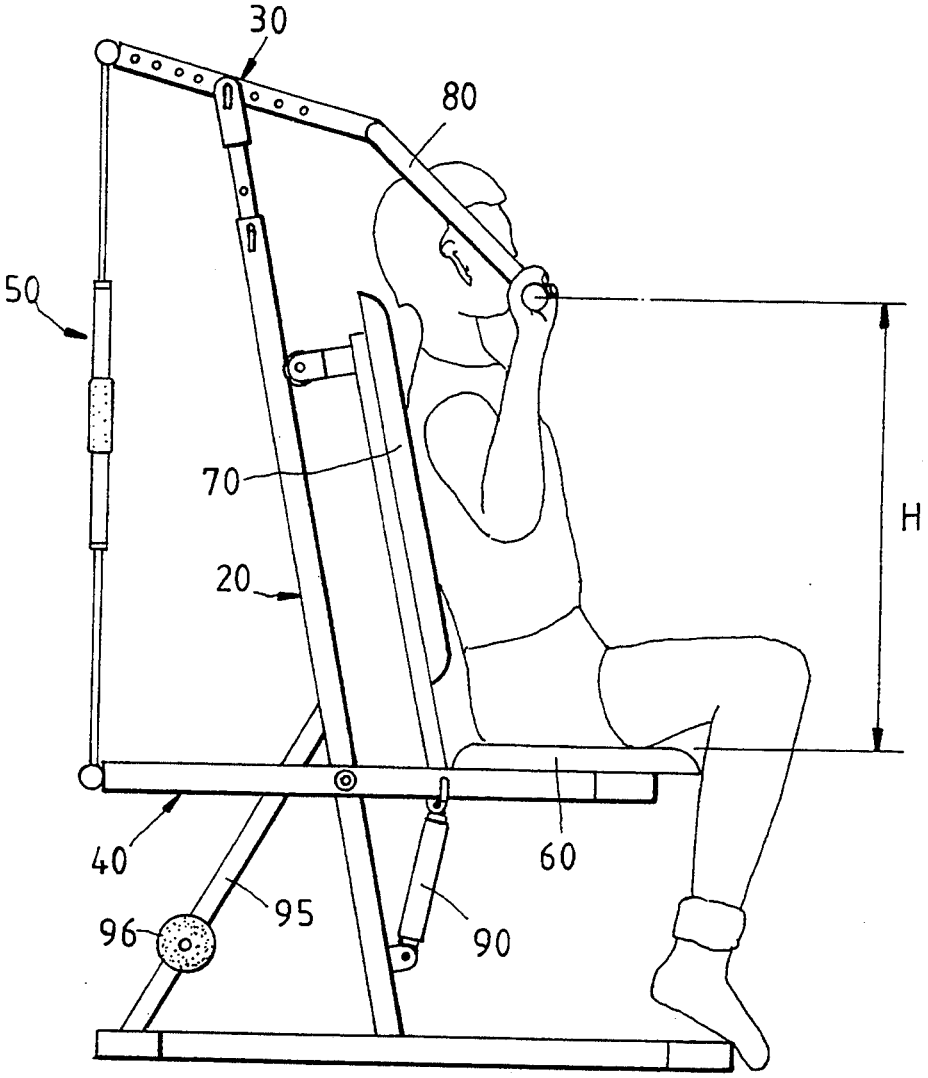
FIGS. 8 and 9 are schematic views illustrating the present invention in action.
Figure 9:
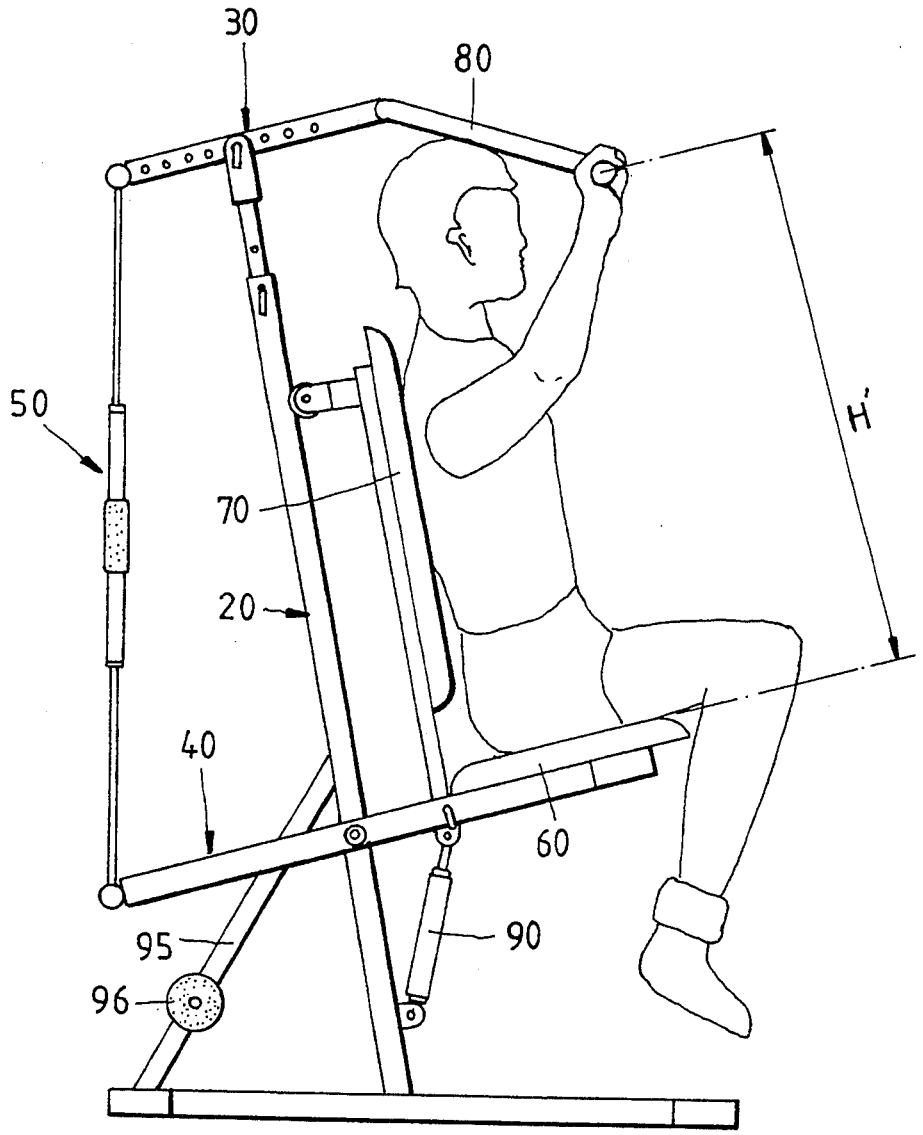
Figure 10:
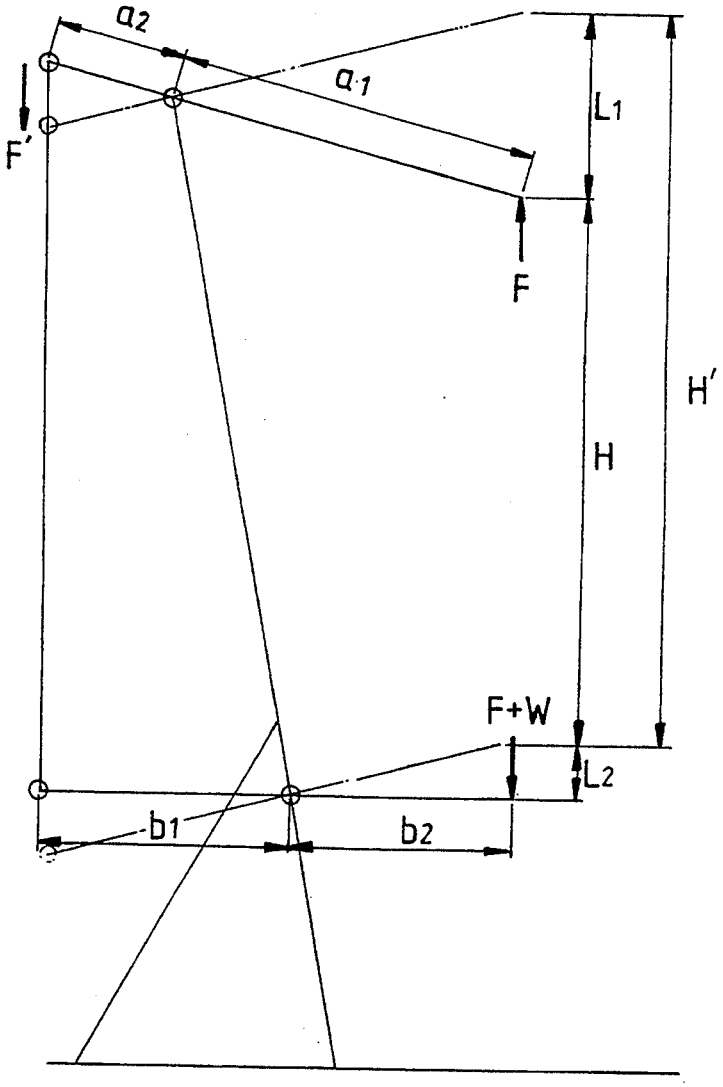
FIG. 10 is a brief diagram illustrating the stress analysis of the present invention.

The operation of the exercise machine of the present invention is schematically illustrated in FIGS. 8, 9 and 10.

An exerciser is seated on the seat pad 60, with both hands holding the handle 80, which is then pushed upwards. The force exerting upwardly on the handle 80 is designated as F. Through the two lever actions of the upper rocking bar member 30 and the lower rocking bar member 40, if the force F is greater than the force exerting on the seat pad 60 by the body weight W of the exerciser and the resultant force (F+W) of a reactive force F′ of the seat pad 60, the handle 80 can be pushed upwards so as to cause the seat pad 60 to rise. It must be noted here that the displacement quantity λ1 of the handle 80 must be greater than the displacement quantity λ2 of the seat pad 60 so as to permit the exerciser to push the handle 80 upwards in a comfortable manner, as illustrated in FIG. 10. Assuming that the force exerting on the handle is designated as F; the body weight of the exerciser, W; the force acting on the seat pad, F′ (reactive forece)+W; the upper rocking bar, a1:a2; and the lower rocking bar, b1:b2; then $$F \times a1 = a2 \times F',\ F' = \frac{a1}{a2} F \geqq \frac{b2}{b1} (F + W)$$

$$F \geqq \frac{a2b2}{a1b1} (F + W),\ F\left(1 - \frac{a2b2}{a1b1}\right) \geqq \frac{a2b2}{a1b1} W$$

$$F\left(\frac{a1b1 - a2b2}{a1\ b1}\right) \geqq \frac{a2b2}{a1b1} W$$

let a1b1>a2b2

$$\text{then } F \geqq \frac{a2b2}{a1b1 - a2b2} W, \text{ and } H' > H$$

EXAMPLE 1

$$a1{:}a2 = 4{:}1 \quad b1{:}b2 = 1{:}1 \rightarrow F \geqq \tfrac{1}{3}W$$

EXAMPLE 2

$$a1{:}a2 = 3{:}1 \quad b1{:}b2 = 1{:}1 \rightarrow F \geqq \tfrac{1}{2}W$$

EXAMPLE 3

$$a1{:}a2 = 2{:}1 \quad b1{:}b2 = 1{:}1 \rightarrow F \geqq W$$

The ratio of b1 and b2 is set in advance at the time when the exercise machine is manufactured. The ratio of a1 and a2 can be altered by adjusting the pivoting point of the upper rocking bar member 30.

The fixation rod member 20 is adjustable and can be adjusted in accordance with the height of an exerciser. The length of the expandable connection rod member 50 can be adjusted by adjusting the pivoting position of the upper rocking bar member 30 or the length of the fixation rod member 20.

An exerciser may use the exercise machine of the present invention by seating or standing on the seat pad 60.

What is claimed is:

1. An exercise machine making use of the body weight of an exerciser as a load weight thereof comprising:

a base;

a fixation rod member fastened obliquely at one end thereof to said base such that a front surface of said fixation rod member forms a greater angle with an upper surface of said base;

an upper rocking bar member provided with a predetermined number of through holes and pivoted adjustably to a top end of said fixation rod member;

a lower rocking bar member pivoted to said fixation rod member and located under said upper rocking rod member;

an expandable connection rod member with both ends thereof pivoted respectively to said upper rocking bar member and said lower rocking bar member such that said expandable connection rod member is located behind said fixation rod member;

a seat pad disposed on another end of said lower rocking bar member;

a back pad having one end pivoted to said lower rocking bar member and another end lapped with said front surface of said fixation rod;

a handle fastened to another end of said upper rocking bar member; and a cushioning member having one end pivoted to said lower rocking bar member and another end pivoted to said fixation rod member for enabling said lower rocking bar member to return to a stationary position at a moderate pace.

2. The exercise machine of claim 1 wherein said expandable connection rod member comprises: a nut of long tubular construction and having two ends provided respectively with a reverse threaded hole; and two threaded rods engageable respectively with said threaded hole and capable of being caused to move simultaneously in opposite directions.

3. The exercise machine of claim 1 wherein said fixation rod member comprises an outer tube with one end fastened to said base, an inner tube received adjustably in an axial hole of said outer tube, and a fastening member for fastening and locating said inner tube and said outer tube.

4. The exercise machine of claim 1 wherein said cushioning member is an oil-pressure cylinder.

* * * * *